US010766296B2

(12) United States Patent
Reitenspies

(10) Patent No.: US 10,766,296 B2
(45) Date of Patent: Sep. 8, 2020

(54) METHOD FOR LACQUERING PENCILS, AND LACQUERING APPARATUS

(71) Applicants: REICOLOR CHEMIE-GMBH CHEMISCHE—UND LACKFABRIK, Altdorf (DE); SCHWAN-STABILO COSMETICS GMBH & CO. KG, Heroldsberg (DE)

(72) Inventor: Juergen Reitenspies, Altdorf (DE)

(73) Assignee: SCHWAN-Stabilo Cosmetics GmbH & Co. KG, Heroldsberg (DE)

( * ) Notice: Subject to any disclaimer, the term of this patent is extended or adjusted under 35 U.S.C. 154(b) by 0 days.

(21) Appl. No.: 15/946,903

(22) Filed: Apr. 6, 2018

(65) Prior Publication Data

US 2018/0326779 A1 Nov. 15, 2018

Related U.S. Application Data

(63) Continuation of application No. PCT/EP2016/073829, filed on Oct. 6, 2016.

(30) Foreign Application Priority Data

Oct. 6, 2015 (DE) ..... 10 2015 219 239

(51) Int. Cl.
*B43K 19/16* (2006.01)
*B43K 19/14* (2006.01)
*B05B 13/02* (2006.01)

(52) U.S. Cl.
CPC ..... *B43K 19/16* (2013.01); *B05B 13/0207* (2013.01); *B43K 19/14* (2013.01); *B05B 13/0214* (2013.01)

(58) Field of Classification Search
CPC .... B05B 3/12; B05D 1/18; B05D 3/06; B05D 3/061
(Continued)

(56) References Cited

U.S. PATENT DOCUMENTS 4,135,098 A * 1/1979 Troue ..... B01J 19/123 250/492.1
4,490,415 A 12/1984 Imamura et al.
(Continued)

FOREIGN PATENT DOCUMENTS

EP 0834351 A1 4/1998
FR 2583150 A1 12/1986
(Continued)

*Primary Examiner* — Dah-Wei D. Yuan
*Assistant Examiner* — Nga Leung V Law
(74) *Attorney, Agent, or Firm* — Laurence A. Greenberg; Werner H. Stemer; Ralph E. Locher

(57) ABSTRACT

In a method for lacquering pencils by the push-through method, a respective pencil is guided through a lacquering chamber in order to apply a lacquer coat. After exiting the lacquering chamber, successive pencils butt against one another and are held against one another at their end sides such at a plurality of pencils form a stable strand which is guided, subsequent to the lacquering chamber, through a drying section, with the result that a respective pencil is held in a hovering manner on leaving the lacquering chamber. It is hereby in particular also made possible to use UV-curing lacquers, with the overall result that a very short total lacquering time for lacquering pencils, in particular cosmetic pencils, is achieved.

13 Claims, 1 Drawing Sheet

(58) Field of Classification Search
USPC ..... 427/289, 290, 291, 293, 434.2, 508
See application file for complete search history.

(56) References Cited

U.S. PATENT DOCUMENTS

| | | | | | |
|---|---|---|---|---|---|
| 4,589,367 | A * | 5/1986 | Renegar | B05C 3/10 | 118/404 |
| 4,744,329 | A * | 5/1988 | Jeanmonod | B05C 3/12 | 118/50.1 |
| 5,674,552 | A | 10/1997 | Ohira et al. | | |
| 2008/0044583 | A1 * | 2/2008 | Schiele | B05C 5/0241 | 427/424 |

FOREIGN PATENT DOCUMENTS

| | | | | |
|---|---|---|---|---|
| JP | S5317425 | A | * | 2/1978 |
| JP | S5317425 | A | | 2/1978 |
| JP | 03216392 | A | * | 9/1991 |
| JP | 03216392 | A | | 9/1991 |
| JP | H07112158 | A | | 5/1995 |
| JP | 09155265 | A | * | 6/1997 |
| JP | 09155265 | A | | 6/1997 |
| JP | 11033473 | A | | 2/1999 |
| JP | 2004067465 | A | | 3/2004 |

* cited by examiner

METHOD FOR LACQUERING PENCILS, AND LACQUERING APPARATUS

CROSS-REFERENCE TO RELATED APPLICATION

This is a continuation application, under 35 U.S.C. § 120, of copending international application No. PCT/EP2016/073829, filed Oct. 6, 2016, which designated the United States; this application also claims the priority, under 35 U.S.C. § 119, of German patent application No. DE 10 2015 219 239.3, filed Oct. 6, 2015; the prior applications are herewith incorporated by reference in their entirety.

BACKGROUND OF THE INVENTION

Field of the Invention

The invention relates to a method for lacquering pencils by the push-through method in which a respective pencil is guided through a lacquering chamber in order to apply lacquer to form a lacquer coat. The invention furthermore relates to a lacquering apparatus for carrying out such a method.

When lacquering pencils, such as, for example, cosmetic pencils, a desired lacquer coat is currently frequently applied by means of the so-called push-through method. In this push-through method, the pencil is pushed through a lacquering chamber in which the lacquer is applied, for example, by spraying etc. On exiting the lacquering chamber, the pencil is then pushed through a stripping ring such that excess lacquer is stripped off and a thin, homogeneous lacquer coat remains on the pencil. Downstream of the lacquering chamber, the pencil typically drops onto a conveyor belt. Here, the lacquer must be incipiently dried at least at its surface to such an extent that the lacquer is not damaged.

In order to ensure this, use is made nowadays of lacquer compositions having a high content of readily volatile solvent. However, owing to the high solvent content, multiple coating is required. Currently, a pencil, which is used as a cosmetic pencil, is guided for example approximately 6 to 8 times in succession through a lacquering chamber. Here, the respective residence time in a lacquering chamber is typically in the range of below 1 second. Here, the lacquer must be sufficiently dried between each lacquering. In order to ensure this, the pencil is guided between two successive lacquering operations over a sufficiently long distance of typically a number of meters with the aid of a suitable mechanical device, for example on a conveyor belt. As a result, the coating operation is comparatively protracted overall. Here, an individual lacquering application with subsequent drying requires approximately 15 minutes overall. Moreover, such systems require a certain amount of space.

SUMMARY OF THE INVENTION

Taking this as the starting point, the object on which the invention is based is to specify an improved method for lacquering pencils and an improved lacquering apparatus.

The object is achieved according to the invention by a method having the features of the main method claim and by a lacquering apparatus having the features of the main apparatus claim. Preferred embodiments are given in the sub claims, and the advantages and preferred embodiments stated with respect to the method can also be applied, mutatis mutandis, to the lacquering apparatus, and vice versa.

To lacquer the pencils, they are first each guided in a conventional manner by the push-through method through a lacquering chamber in order to apply lacquer to form a lacquer coat. According to the invention, provision is now made for the individual pencils to be guided in such a way that they butt against one another and are also held against one another with a certain force at their end sides such that a plurality of pencils form a self-supporting strand. This strand is guided to the lacquering chamber and then through a drying section. Here, the guidance occurs such that a respective pencil is held in a hovering manner on leaving the lacquering chamber, thus directly after exiting the lacquering chamber. What is meant by this is that a respective individual pencil, after leaving the lacquering chamber, that is to say downstream of the stripping ring, does not bear at any bearing, supporting or guide point. The pencil is a part of the strand formed by the individual pencils and is therefore held exclusively by the holding forces at the end sides between a preceding and a following pencil, between which it is clamped in as it were. The strand itself for its part is supported at supporting points in a front region and in a rear region, wherein these supporting points are situated upstream or downstream of the respective pencil which has just exited the lacquering chamber.

The pencil leaving the lacquering chamber is additionally guided downstream of the lacquering chamber through a drying section, with the result that at least sufficient incipient drying of the applied lacquer coat occurs until the respective pencil reaches the first supporting point.

The particular advantage here can be seen in the fact that, by virtue of the as it were hovering guidance, on the one hand a relatively long time period is available for a first drying and, on the other hand, an active drying in the drying section can simultaneously occur during the hovering guidance of the respective pencil. This results overall in a shortening of the required time for coating and for drying the lacquer coat. As a result, there is the possibility of using other lacquers, for example having a lower solvent content, with the overall result that the number of coatings can be reduced.

The lacquering apparatus according to the invention for lacquering pencils by the push-through method contains the lacquering chamber and a feed unit for feeding and conveying the pencils, wherein the feed unit is formed in such a way that, during operation, a plurality of pencils are conveyed in direct succession and so as to form a self-supporting strand. To ensure this self-supporting strand consisting of individual pencils, the lacquering apparatus furthermore has an abutment against which the strand is pressed during operation such that thus a counter-force is produced, with the result that the pencils form the self-supporting strand or are supported during the formation of the self-supporting strand. Furthermore, there is formed, subsequent to the lacquering chamber, the drying section in which a respective pencil is held in a hovering manner after leaving the lacquering chamber. A guide point for the pencil is therefore formed preferably only at the end or subsequent to the drying section. In an expedient manner, the abutment simultaneously forms a guide point for the strand and is formed for example as a (ring) element through which the strand is pushed. A counter-force is produced by the friction. This abutment is, for example, in particular an abutment at the end of the drying section, for example in the form of a rubber or sealing ring, through which the strand is pressed.

The term "pencil" is to be understood in the present case as meaning in general an elongate element preferably having a uniform cross-sectional area. The pencils here are in particular writing, coloring or else cosmetic pencils in which in general a core is inserted within a typically cylindrical basic body. The basic body frequently consists of wood. Alternatively, it can also consist of plastic. Particularly in the case of cosmetic pencils, a particularly high-grade lacquer coat, for example a glossy lacquer, is frequently desired.

Here, the individual pencils typically have a length of 5 to 20 cm. Especially in the application for cosmetic pencils, the pencil length is typically in the range from approximately 10 to 13 cm, being in particular 11.5 cm.

In conventional lacquering apparatuses, the throughput of pencils is in the range from 50 to 200 pencils per minute. This throughput is also achieved by the present lacquering apparatus. The residence time per pencil in the lacquering chamber and thus also in the drying chamber is typically less than 1 second and is in particular approximately 0.5 seconds.

In an expedient embodiment, to form the desired self-supporting strand, the adhesiveness of the lacquer is also utilized. Two successive pencils are therefore preferably also held against one another by the applied lacquer. When lacquering, for example a certain content of the liquid lacquer penetrates between the pencils at the end sides, or bridges at least the abutment point at the end sides, with the result that a holding force is exerted by the lacquer itself.

In an expedient manner, the strand is enveloped by a continuous, interruption-free lacquer coat. The strand is thus coated continuously in the lacquering chamber such that the desired continuous, interruption-free lacquer coat is formed.

In a preferred embodiment, an active drying is carried out in general in the drying section, i.e. a drying device is arranged in the drying section in order to accelerate the drying. This device is in particular a UV lamp and the lacquer used is a UV curing lacquer.

The lacquer here is in particular a solvent-free lacquer. It is preferably made up of 100% of pure lacquer without solvent and other binders. The term "pure lacquer" is to be understood here as meaning that it contains no volatile substances which escape during the drying operation. As a result of this measure, the applied lacquering agent therefore remains completely on the pencil surface. By comparison with solvent-containing lacquers in which a large part of the applied lacquer does evaporate, it is thereby possible to considerably reduce the number of individual coating operations. As a result, the lacquering time for an individual pencil is considerably reduced overall.

The UV lamp used here is preferably an LED lamp. This is distinguished by a very low heat input by comparison with, for example, halogen lamps. As a result, it is possible to dispense with cooling.

It is ensured in the drying section that homogenous, all-side illumination of the pencil takes place. For this purpose, there are arranged, for example, a number/multiplicity of individual lamps around a central axis along which the strand is conveyed. Alternatively, there is also the possibility that UV light can be deflected onto the surface of the pencil with the aid of suitably curved mirrors.

In an expedient development, the drying section is furthermore formed as a drying chamber filled with protective gas. The protective gas used is, for example, nitro-gen or else $CO_2$. This measure avoids an undesired reaction between the atmospheric oxygen and lacquer constituents, in particular free radicals of the UV lacquer. Accordingly, therefore, the drying chamber is also formed as an at least largely closed chamber which is provided with a protective gas connection which is connected, during operation, to a protective gas supply. Continuous flushing of the drying chamber with the protective gas preferably takes place.

The drying chamber has on the inlet side an inlet opening for the strand, wherein this inlet opening preferably has a diameter which is larger than the pencil diameter such that thus, on entry into the drying chamber, the pencil is furthermore held in a freely hovering manner without a supporting point on the pencil circumference. At the same time, the opening cross section is kept as small as possible in order to be able to maintain the desired protective gas atmosphere within the drying chamber. Alternatively, or in addition to this, in an expedient embodiment, a tube is arranged between the outlet side of the lacquering chamber and the inlet side of the drying chamber, which tube is sealed from the surroundings and is in particular likewise filled with protective gas.

In a preferred embodiment, there is provision that the drying chamber provided with the active drying device, in particular with the UV lamp, is spaced from the outlet of the lacquering chamber by a number of centimeters. Here, the spacing is in particular more than 2 cm and is furthermore preferably for example at most 20 cm. In particular, the spacing is approximately 5 to 15 cm. This measure ensures that UV rays do not reach the outlet of the lacquering chamber and lead to drying there is an undesired manner. Since the pencil is typically guided through a stripping ring on the outlet side of the lacquering chamber, this would otherwise result in certain circumstances in the lacquer curing at the stripping ring in an undesired manner, which would subsequently lead to the surface being damaged.

In an expedient manner, there is further provision that the drying section has a length which is larger than a pencil length. A respective pencil is therefore held in a hovering manner within the drying section. Essential for this is the formation of the strand and the holding force exerted on the individual pencil at its end sides. At the same time, the drying section is comparatively short since, owing to the active drying, in particular UV curing, a short residence time is sufficient. The drying section, in particular the drying chamber, typically has a length in the range of 1 times or 1.5 times to 3 times the pencil length. In particular, the length is in the range from 10 to 30 cm, especially in the range from 12-20 cm.

In an expedient manner, a first, rear guide or supporting point is arranged on the outlet side of the lacquering chamber, which is formed in particular by a stripping ring of the lacquering chamber through which the strand is guided. Furthermore, there is preferably arranged a second, front guide or supporting point at the end of the drying section, in particular on the outlet side of the drying chamber. No further support occurs between these supporting points. The strand therefore experiences no support between the outlet of the lacquering chamber and the outlet of the drying chamber. Between these guide points, the respective pencil is thus guided in a hovering manner by the strand. The spacing between the two guide points is for example in the range between 1.5 and 3 times the pencil length.

Overall, the strand is therefore formed by a plurality of individual pencils, preferably by at least 3 and furthermore by at least 5 pencils.

Subsequent to the drying section, there is furthermore arranged a mechanical separating device for separating the strand into the individual pencils. A continuous strand is therefore formed in the input side of the lacquering chamber between the mechanical separating device. Here, in a preferred embodiment, the mechanical separating device is a separating device which exerts a lateral force on the strand such that the (adhesive) connection on the end sides between two successive pencils is broken. In a particularly preferred embodiment, the separating device is an impact element which is inclined with respect to the conveying direction of the strand and against which the strand is guided.

After the strand has been separated into the individual pencils, the latter are either collected in a bin or dropped onto a conveyor belt.

The pencils are overall preferably guided continuously through the lacquering chamber with subsequent drying chamber. Alternatively, to a continuous guidance, a discontinuous, intermittent guidance of the pencils can also take place. In this case, the strand is intermittently conveyed by a pencil length in accordance with the cycle rate in the lacquering chamber. Depending on the particular design, whether continuous or intermittent conveyance, the feed unit for feeding and conveying the pencils is formed in a suitable manner.

In an expedient embodiment, a respective pencil runs multiply through a lacquering stage formed by a lacquering chamber and subsequent drying section until the desired total application of lacquer has been reached. Here, owing to the use of a "100%" lacquer (solvent-free lacquer) only few lacquering stages are required. In an expedient manner, at most four and in particular only about two lacquering stages are provided. The total number of lacquering stages forms a lacquering section. The number of lacquering stages is therefore reduced by at least half by comparison with conventional methods.

Here, in an expedient manner, a plurality of lacquering stages are formed in direct succession such that thus the strand is guided through the plurality of lacquering stages without the pencils being separated there between. In an expedient manner, two or else three lacquering stages are formed in direct succession. In this case, the strand therefore has a plurality of individual pencils, wherein the number is typically more than 10 and up to about 20 to 30 pencils. Here, the number of lacquering stages directly connected in succession is chosen in such a way that the pencil is completely lacquered after a single pass through the lacquering section formed by the lacquering stages.

According to an expedient development, a transparent clear lacquer is applied in the first lacquering stage and a pigmented lacquer is applied in a subsequent lacquering stage to an uncoated raw pencil. The application of a clear lacquer coat considerably improves the cover result during the subsequent application of the pigmented lacquer. Particularly with raw pencils consisting of wood, a particularly good uniform result is achieved by the clear lacquer. A transparent priming coat is applied by the clear lacquer. The particular advantage of this initially transparent first coat can also be seen in the fact that quick UV curing is made possible owing to the lack of pigments. This transparent base coat also forms a reflecting surface which also has a beneficial effect for the UV curing of the subsequent color application since the UV light is reflected on the previously applied priming coat, with the result that effective UV curing also occurs on the inner side of the applied lacquer coat.

In addition, it is not necessary for complete drying out of the applied lacquer coat to occur in the drying section. Complete drying out can also take place subsequent to a respective lacquering stage or subsequent to the overall lacquering section, for example by air drying or else by an additional drying-out chamber, for example a UV chamber.

At the start of the method when thus the first pencils are to be provided with the lacquering coat, a guide rod is used as an aid for forming the strand, against which guide rod the first pencil is pressed, and which has a sufficient (minimum) length such that it is supported on the guide point in particular at the end of the lacquering stage.

Other features which are considered as characteristic for the invention are set forth in the appended claims.

Although the invention is illustrated and described herein as embodied in a method for lacquering pencils, and lacquering apparatus, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

In the figures, parts acting in the same way are provided with the same reference signs.

Figure 1:
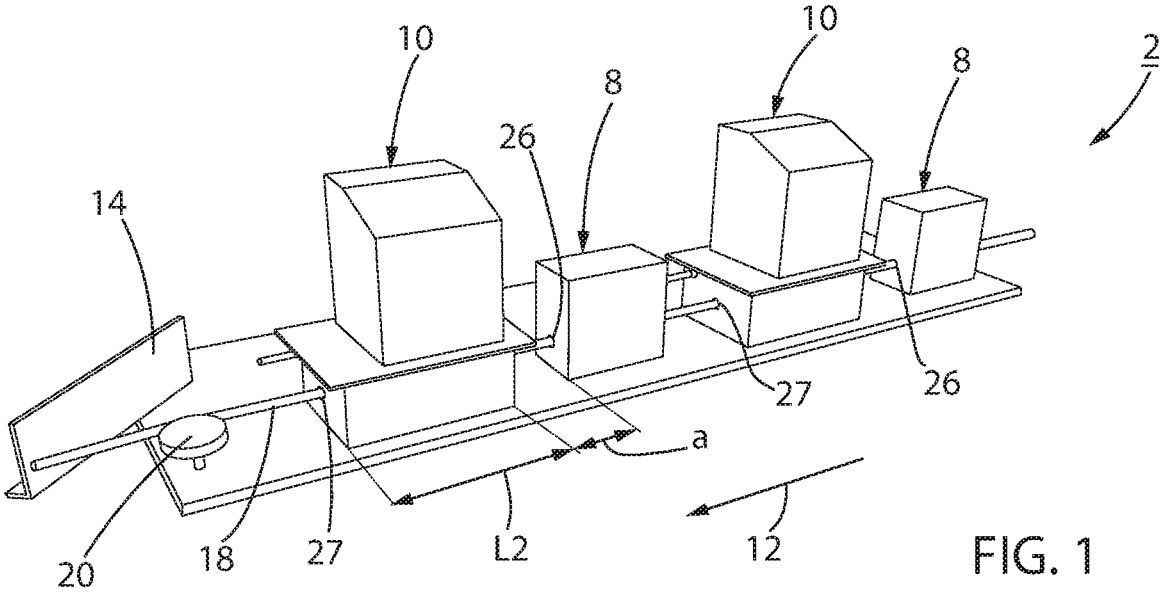
FIG. 1 is a diagrammatic, perspective view of a lacquering apparatus according to the invention.
Figure 3:
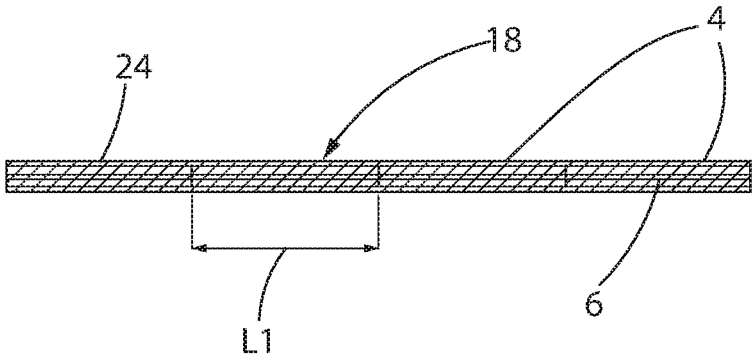
FIG. 3 is a sectional view through a strand.

Referring now to the figures of the drawings in detail and first, particularly to FIG. 1 thereof, there is shown a lacquering apparatus 2 which forms a system for lacquering individual pencils 4. Here, the pencils 4 are in particular pencils 4 provided with a core 6, in particular cosmetic pencils. Such pencils 4 typically have a pencil length l1 (see in this respect FIG. 3) of about 10 to 20 cm and, in the case of cosmetic pencils, typically a length l1 of about 12 cm. The diameter is typically in the range from about 0.5 to 2 cm.

The lacquering apparatus 2 has a lacquering section formed by a plurality of, in the exemplary embodiment two, lacquering stages. Here, a respective lacquering stage contains a lacquering chamber 8 and a drying chamber 10. Here, the drying chamber 10 is arranged subsequent to the lacquering chamber 8 in a conveying direction 12. The lacquering apparatus 2 has furthermore a drive (not illustrated in detail here) or a feed unit, via which drive or feed unit the individual pencils 4 are fed to the lacquering section, in particular the first lacquering chamber 8. An inclined shield, also referred to as impact plate, is arranged at the end of the lacquering apparatus 2 as a mechanical separating device 14.

The individual pencils 4 are guided horizontally through the entire lacquering section, that is to say from the start of the first lacquering chamber 8 of the first lacquering stage to the separating device 14, as a continuous, horizontally oriented strand. Here, the horizontal strand 18 is formed by a plurality of individual pencils 4 which butt against one another at their end sides 19.

Upstream of the separating device 14, there is additionally arranged a guide element 20 for the strand 18. This is formed in particular as a guide roller which has a concave guide groove in which the strand is partially located.

Figure 2:
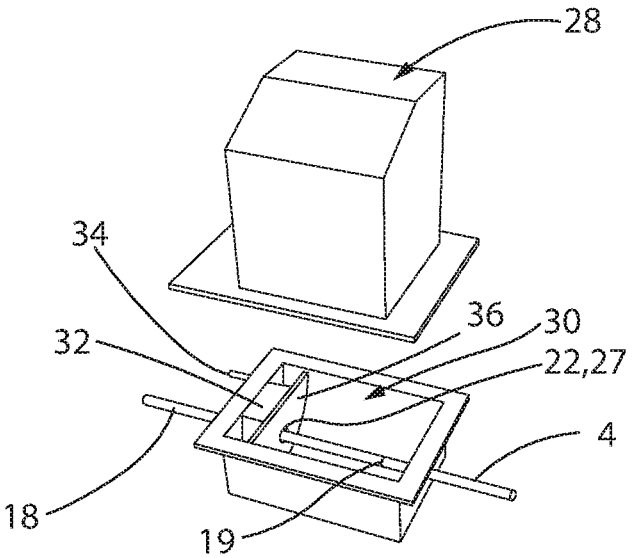
FIG. 2 is a perspective, exploded view showing a drying chamber.

The individual pencils 4 and thus the strand 18 are pushed from behind in the conveying direction 12 through the entire lacquering section by means of the feed unit (not illustrated in detail here). Here, the strand 18 is guided, inter alia, also through an annular guide opening in the drying chamber 10 which forms an abutment 22. The term "abutment" here is to be understood as meaning an element which exerts a force on the strand 18 which is directed counter to the conveying direction 12. In the exemplary embodiment, the abutment 22 is formed as a ring of a soft material, in particular of felt, through which the strand 18 is pushed (see in this respect also FIG. 2).

As a result of this counter-force, the individual pencils 4 are pressed against one another at their end sides and thus form the stable, self-supporting strand 18. The self-supporting property is additionally assisted by the lacquering coat 24 (see in this respect FIG. 3) which is applied in the lacquering chambers 8 and which forms a continuous coat over the whole strand 18. Therefore, the abutment points of the pencils 4 are also bridged by the lacquering coat 24 such that, owing to the adhesiveness of the lacquer, the individual pencils 4 are held together to form the self-supporting strand. Here, some lacquer also partially penetrates at the abutment points, for example into interstitial regions. This leads overall to a certain degree of adhesive bonding between the individual pencils 4 in the region of their abutment points. A holding force is first of all exerted by the liquid lacquer and further on by the cured lacquer.

The lacquering in a respective lacquering chamber 8 takes place in a manner known per se by the so-called push-through method. For this purpose, a respective pencil 4 is inserted into the lacquering chamber 8 and provided there with a lacquer coat for example by spraying or immersion. The pencil then leaves the lacquering chamber 8 via a stripping ring (not illustrated in detail here) which is arranged directly at the end of the lacquering chamber 8 on an outlet side. This outlet side therefore forms a first guide point 26 for the strand 18. The drying chamber 10 adjoins in the conveying direction 12 after a spacing a. Here, the spacing "a" is in the range from 2 to 10 cm, for example.

The strand 18 is introduced into the drying chamber 10, wherein here a corresponding opening larger than the cross section of the strand 18 is formed such that the strand 18 thus freely enters the drying chamber 10 without contact with a wall or some other guide.

At the end of the drying chamber 10 there is formed the aforementioned abutment 22 which is arranged in particular as a ring element, in particular of a soft material, for example of felt. The abutment 22 simultaneously forms a second guide point 27 for the strand. The abutment 22 is preferably arranged in a removable receptacle 32 such that the abutment 22 (felt ring) can be exchanged in a simple manner.

In the exemplary embodiment, the drying chamber 10 is subdivided into a lower sub region and an upper hood-like sub region. Here, in the exemplary embodiment, the upper hood-like sub region is formed as a UV lamp 28 which thus radiates downwardly into the lower sub region. Arranged in the latter is a curved, in particular elliptically formed, mirror 30 such that complete homogeneous illumination of the strand 18 over the entire circumference is obtained by UV light. Here, UV light tailored to the UV lacquer used is radiated. Here, a UV light with a predetermined wavelength or else a plurality of wavelengths or broad-band UV light can be radiated. LED light elements are preferably used to produce the UV light.

Furthermore, the drying chamber has a protective gas connection 34 via which a protective gas, in particular nitrogen, can be introduced into the drying chamber 10. During operation, the protective gas flows out via a nozzle 36 into the drying chamber. The protective gas leaves the drying chamber on the opposite inlet side via the free opening through which the strand 18 is inserted. A continuous protective gas flow is established in a suitable manner.

The drying chamber 10 furthermore has a length L2 which is preferably larger than the pencil length L1.

After leaving the last drying chamber 10, the strand is guided via the aforementioned guide element 20 towards the separating device 14. Owing to the inclined separating device 14, the strand 18 butts against the separating device 14, which exerts a lateral force which is sufficient to separate the strand 18 into the individual pencils 4 again.

The lacquering apparatus illustrated in FIG. 1 with the two lacquering stages forms a complete lacquering section, i.e. the pencils 4 separated again at the end are provided with the finished lacquer coat 24.

Here, a clear lacquer is first applied in the first lacquering stage and a colored lacquer, for example a black lacquer, is applied in the second lacquering stage. Therefore, in the exemplary embodiment described here, only a single colored lacquer coat is applied.

The lacquer is generally a UV curable lacquer, which has no constituents which escape during drying, for example solvents or binders. Overall, a hard, customarily high-gloss lacquer coat 14 is formed hereby.

Overall, the method described here and the lacquering apparatus 2 illustrated afford efficient lacquering in particular of cosmetic pencils 4, wherein only a comparatively small space requirement in the conveying direction 12 of for example about 1 to 2 m for the entire system (lacquering section) is necessary. The lacquering time for a pencil 4 is considerably shortened by the method described here in comparison to the traditional methods.

The following is a summary list of reference numerals and the corresponding structure used in the above description of the invention:

2 Lacquering apparatus
4 Pencil
6 Core
8 Lacquering chamber
10 Drying chamber
12 Conveying direction
14 Separating means
18 Strand
19 End side
20 Guide element
22 Abutment
24 Lacquer coat
26 First guide point
27 Second guide point
28 UV lamp
30 Mirror
32 Receptacle
34 Protective gas connection
36 Nozzle
a Spacing
l1 Pencil length
l2 Length

The invention claimed is:

1. A method for lacquering pencils via a push-through method, which comprises the steps of:

guiding a respective pencil horizontally through a lacquering chamber for applying lacquer thus forming a lacquer coat, after exiting the lacquering chamber, successive ones of the pencils butt against one another and are held against one another at their end sides such that a plurality of the pencils form a horizontal strand, the respective pencil being held exclusively by the holding forces at the end sides between a preceding pencil and a following pencil of the strand; and guiding the strand, downstream of the lacquering chamber, horizontally through a drying section, with a result that the respective pencil is held horizontally in a hovering manner on leaving the lacquering chamber.

2. The method according to claim 1, wherein two successive ones of the pencils are held against one another by the lacquer applied.

3. The method according to claim 1, wherein the strand is enveloped by a continuous, interruption-free lacquer coat.

4. The method according to claim 1, which further comprises pressing the strand against an abutment such that the pencils are pressed against one another at the end sides.

5. The method according to claim 1, which further comprises disposing a UV lamp in the drying section and the lacquer used is a UV-curing lacquer.

6. The method according to claim 5, which further comprises forming the drying section as a drying chamber filled with protective gas.

7. The method according to claim 5, wherein the drying section provided with the UV lamp is spaced by a number of centimeters from an outlet of the lacquering chamber.

8. The method according to claim 1, wherein the drying section has a length which is larger than a pencil length.

9. The method according to claim 1, wherein an outlet of the lacquering chamber has a first guide point for the pencil, and the drying section has, at a spacing from the lacquering chamber, a second guide point for the pencil, wherein no further guide point is disposed between the first and second guide points.

10. The method according to claim 1, which further comprises disposing a mechanical separator for separating the strand into the individual pencils subsequent to the drying section.

11. The method according to claim 1, wherein the lacquering chamber and the drying section form a lacquering stage, and in that a plurality of lacquering stages are formed directly in succession and form a lacquering section, in such a way that the pencil is completely lacquered after a single pass through the lacquering section.

12. The method according to claim 1, wherein the lacquering chamber and the drying section form a first lacquering stage, and wherein the method further includes the steps of: applying a clear lacquer in the first lacquering stage; and applying a pigmented lacquer in a subsequent lacquering stage formed by another lacquering chamber and drying section.

13. A method for lacquering pencils via a push-through method, which comprises the steps of:

guiding a respective pencil horizontally through a lacquering chamber for applying lacquer thus forming a lacquer coat, after exiting the lacquering chamber, successive ones of the pencils butt against one another and are held against one another at their end sides such that a plurality of the pencils form a horizontal strand, the respective pencil being held exclusively by the holding forces at the end sides between a preceding and a following pencil; and guiding the strand, downstream of the lacquering chamber, horizontally through a drying section, with a result that the respective pencil is held horizontally in the strand in a hovering manner without a supporting point on a circumference of the respective pencil on leaving the lacquering chamber.

* * * * *